United States Patent [19]

Zuliani

[11] Patent Number: 4,995,564

[45] Date of Patent: Feb. 26, 1991

[54] REWINDER FOR THIN TAPE

[75] Inventor: Sandro Zuliani, Bottens, Switzerland

[73] Assignee: Bobst SA, Switzerland

[21] Appl. No.: 403,820

[22] Filed: Sep. 7, 1989

[30] Foreign Application Priority Data

Sep. 16, 1988 [CH] Switzerland ..... 03474/88

[51] Int. Cl.[5] ..... B65H 18/08; B65H 59/36; B65H 20/24; B23Q 3/14

[52] U.S. Cl. ..... 242/67.10 R; 242/75.51; 242/72 R; 269/48.10; 279/2 R; 226/119

[58] Field of Search ..... 242/67.1 R, 75.51, 75.52, 242/67.3 R, 68.1, 68.2, 72.1, 72 B, 72 R; 226/118, 119, 44; 269/48.1; 279/2 R

[56] References Cited

U.S. PATENT DOCUMENTS

| | | | |
|---|---|---|---|
| 2,708,554 | 5/1955 | Welsh et al. | 242/75.51 X |
| 2,759,680 | 8/1956 | Johnson | 242/68.2 |
| 2,797,089 | 6/1957 | Lorig | 226/119 |
| 2,825,016 | 2/1958 | Bailey | 242/75.51 X |
| 3,001,736 | 9/1961 | Schultz et al. | 242/72 R |
| 3,796,360 | 3/1974 | Alexeff | 226/119 |
| 3,893,636 | 7/1975 | Wise et al. | 242/67.3 R X |
| 4,635,870 | 1/1987 | Owens | 242/72.1 X |

FOREIGN PATENT DOCUMENTS

| | | | |
|---|---|---|---|
| 2096183 | 10/1982 | United Kingdom | 242/75.51 |

*Primary Examiner*—Daniel P. Stodola
*Assistant Examiner*—John P. Darling
*Attorney, Agent, or Firm*—Hill, Van Santen, Steadman & Simpson

[57] ABSTRACT

A rewinding device includes an upper frame linked to a lower frame and a tape rewinding unit for each tape. Each unit has a motor-driven hub for a take-up reel being positioned on the upper frame, and a tensioning arrangement including a slidable dancer disposed on a vertically disposed sliding bar having a roller receiving a loop of said tape prior to being wound on said reel, the tensioning arrangement includes an upper and lower switch which control rotation of the motor of the take-up reel in response to the position of the dancer.

10 Claims, 6 Drawing Sheets

REWINDER FOR THIN TAPE

BACKGROUND OF THE INVENTION

The present invention is directed to a rewinder for thin tapes, especially those tapes used for supporting a metal foil which is being processed in a machine for processing sheet-like material, such as boards, paper and plastic.

A converting machine, which is designed, for instance, for hot or cold application of a metallized film, in accordance with one of several images on a sheet-like material being processed in the machine, generally includes at least one unwinding device for foil tapes, and means for unrolling the tape intermittently in such a way as to allow its surface to be utilized optimally and a mechanism for rewinding the remaining foil tape after the transfer.

Among the known devices for foil tape rewinding is a terminal wind-up reel which receives the foil tape. Currently the trade uses several foil tapes which extend parallel throughout the machine operating width. This arrangement compulsorily entails the use of the same number of terminal wind-up reels as foil tapes being used. Thus, for instance, if four foil tapes are used, four terminal wind-up reels will be necessary and will be positioned pairwise on two crosswise pivoting bars secured between the frames of the converting machine.

Every terminal wind-up reel is connected to its pivoting bar by means of a lever arm. The terminal wind-up reels are driven by means of two rotary shafts, which are arranged to extend crosswise between the frames of the converting machine. The circumference of these rotary shafts will make contact with the circumference of the circular lateral guides of each of the terminal wind-up reels which procedure involves a continuous frictional driving action. The different rates of advance of various foil tapes, thus, causes irregular rotation of the terminal wind-up reels. This means that, in certain cases, a terminal wind-up reel will be rotated, whereas another, for example one in which the foil tape is not being pulled forward, will remain motionless and have its circumference rubbing against the surface of the rotary shaft.

The designs mentioned above have certain drawbacks, for example they can only be arranged within the machine, which causes difficulty in obtaining access to the various terminal wind-up reels and increases the down-time of the machine when a fully rewound or filled reel has to be replaced by an empty reel. Another drawback is that, on account of the design of the terminal wind-up reel frictional drive, there is no possibility of avoiding a friction between the circumference of the reel and the rotary shaft, which will cause, in certain cases, a build-up of an undesired polish or smoothing of the contact surfaces. Such a polishing or smoothing of the contact surfaces can interfere with the frictional drive and result in a compromising of the desired tension on the foil tape on the occasion of its advance. In this connection, the wear of the circumferential parts of the reels should also be given consideration.

SUMMARY OF THE INVENTION

The present invention is directed to overcoming the problems existing in devices for rewinding thin tapes. To accomplish these goals, the present invention is directed to a rewinder for thin tapes, especially so-called tape-based metallized foils, being used in a machine which processes sheet-like material, such as board, paper or plastic, said rewinding device including terminal wind-up reels having means for exerting a mechanical tension on a thin tape, as well as means for driving said terminal wind-up reels. The improvement in such an arrangement is that the device includes an upper frame connected to a lower chassis by means of vertical columns, said upper frame being equipped with at least one rewinding appliance unit, each unit including a motor assembly with reduction gear, an axle extending from said reduction gear for carrying a reel carrier hub receiving a terminal wind-up reel, a first roller and a third roller for each rewinding appliance unit for guiding the foil tape, said means for tensioning including at least one vertical slide bar arranged between the upper frame and the lower chassis for each unit, a dancer with a second roller being mounted for movement on said slide bar, motor control means including an upper and lower end switches actuated by movement of the dancer therebetween, means for determining a tape breakage including a tape breakage switch being arranged in the vicinity of the vertical slide bar below said lower switch of the control means, hoist means having a lifting device for raising the dancer, said lifting device including a contacter designed to engage a control switch for disengaging said machine in response to the raising of the dancer by the hoist.

Preferably, the reel carrier hub contains tightening clamps for supporting each of the reels. The tightening clamps include a pair of rings having radially extending slots receiving blade-like members, said rings having cam surfaces coacting with cam surfaces provided on the ends of said blade members and means for shifting the two rings axially relative to each other to cause the blade-like members to be forced radially outward for clamping a reel on said reel carrier hub.

The advantages obtained by means of the present invention consist essentially in that the terminal wind-up reel are situated outside of the machine and present a very easy access so that the production down-time can thereby be reduced to the minimum. An additional advantage of the invention consists in the fact that the individual drive system of every terminal wind-up reel discards any friction between the latter and the drive element and uses individual tensioning means for each of the foil tapes.

As a whole, the device distinguishes itself by an equally easy accessibility and changeability of the terminal wind-up reels enhanced by accurate and steady control of the rewinding tension.

Other advantages and features of the invention will be readily apparent from the following description of the preferred embodiments, the drawings and claims.

DESCRIPTION OF THE PREFERRED EMBODIMENTS

Figure 1:
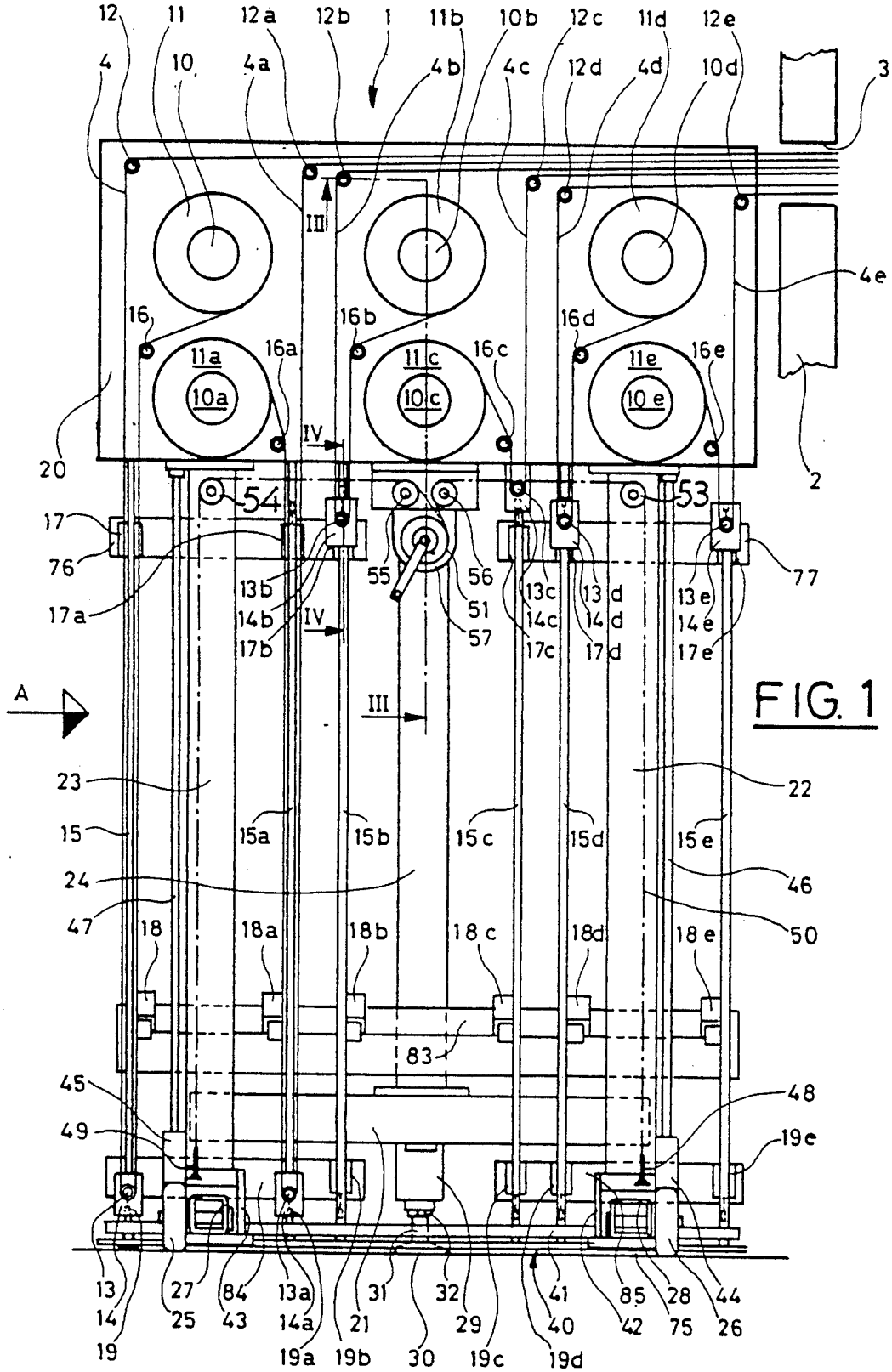
FIG. 1 is a side view of the rewinding assembly of the present invention.

The principles of the present invention are particularly useful in a rewinder, generally indicated at 1 in FIG. 1. The rewinder 1 is arranged to extend perpendicular to a platen press of which only the left-hand lateral frame 2 is shown in this Figure. The frame 2 has an aperture 3 through which the foil tapes **4–4*e*** are guided after having been processed by the platen press.

The foil tapes **4–4*e* are conveyed through the platen press to extend in the same direction as the paper or board sheet on which a portion of the foil material is to be applied. If these foil tapes 4–4*e* are then ultimately to be delivered to the rewinder, they should, for obvious reasons, be given another direction, which change will take place within the press by use of idler rolls (not shown) appropriately arranged in such a way that the foil tape will appear within the aperture 3 in a flat position extending into the rewinder In order to simplify the description, only one foil tape rewinding appliance unit will be discussed. In fact, the rewinding appliance units of the other tapes are similar execution and their operation as well as their design can be assimilated to the rewinding appliance unit to be described hereinafter. To this end, they will be referred to by the same element numbers with the designation of the letters a–e. It should be noted that the rewinder 1 is constructed to handle six foils 4–4*e*** and has six units.

Figure 2:
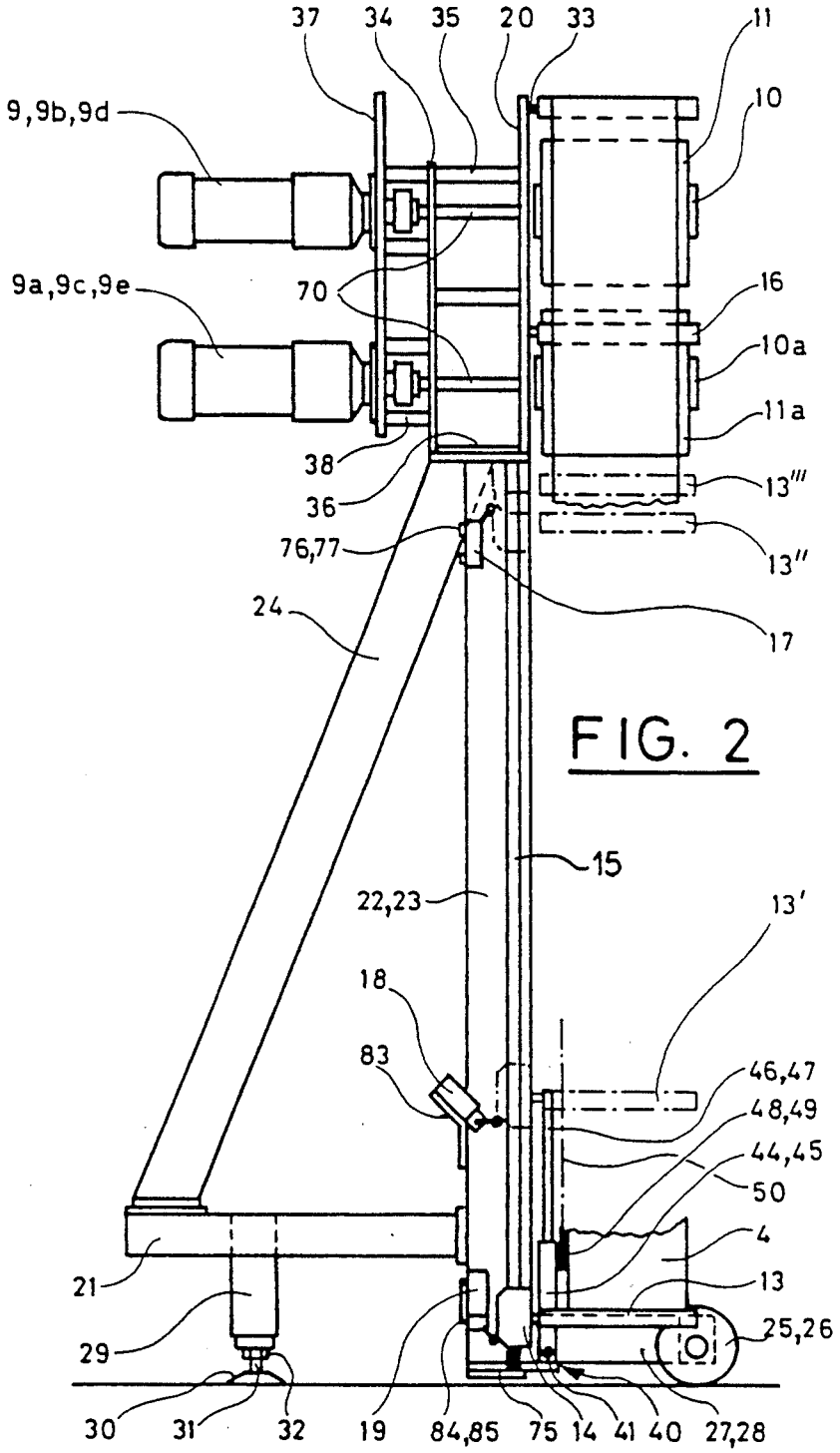
FIG. 2 is an end view taken from the direction of arrow A of FIG. 1.

The rewinder appliance 1 used for the tape 4 includes a motor assembly with a reduction gear 9 (see FIG. 2). Extending from each of the reduction gear is an axle 70 on which has been fitted a carrier hub 10. This hub is to be provided with a terminal wind-up reel 11 on which the foil tape 4 will be rewound after it is processed within the platen press. As illustrated in FIG. 1, the six hubs **10–10*e* are arranged in an upper row of hubs 10, 10*b* and 10*d* and a bottom row of hubs 10*a*, 10*c* and 10*e*. Thus, the hub 10*a* is below the hub 10**.

The foil tape 4 extends out from the platen press and is guided by a first roller 12 (see FIGS. 1 and 2) before it travels around a part of the circumference of a second roller 13, which is mounted for rotation on a dancer 14, which is to be shifted along a vertical slide bar 15 that has a shape of an axle or rod that extends between a crossbar 75 (FIG. 2) fitted on a lower part of the columns 22 and 23 on the one hand, and a pad 36 on an upper frame 20. The foil tape 4 finally travels around a third roller 16 before being fed onto the terminal wind-up reel 11. The swinging range of the dancer 14 is limited by an upper end switch 17 and a lower end switch 18, as well as by a tape breakage switch 19 (see FIG. 2). The function of these various switches will be explained hereinafter.

All components of the rewinding appliance are carried by an assembly comprising an upper frame 20 connected to a lower chassis 21 by means of columns 22 and 23 and a brace or prop 24. The lower chassis 21 also includes a mechanism designed for shifting or moving the rewinder 1. This mechanism includes two rollers 25 and 26, which are both mounted for rotation on brackets 27 and 28, which brackets are welded onto a lower part of both columns 22 and 23. This mechanism also includes a rear support 29, which is welded on a connection of a beam made up of the lower chassis 21. The rear support 29 includes a cup 30 provided with a threaded rod 31 with a nut 32. The threaded rod 31 engages the tapping of the rear support 29. Owing to this arrangement there is a possibility to level and shift the rewinder 1 by means of a lifting device (not shown) which may be a hand truck with rollers and a hoisting appliance. In this way, the rear support 29 of the rewinder, after having been lifted from the ground, may be shifted as desired.

The upper frame 20, as illustrated in FIG. 2, is made up of a front plate 33 connected to a rear plate 34 by means of tubular struts 35 and of a pad 36, which is bolted on an upper part of the columns 22 and 23 and on the brace 24. The motor assemblies with their reduction gears **9–9*e* are secured on a side guide 37 connected to the rear plate 34 by means of bushing 38. Various bolts (not shown) pass through the various plates, the side guides, as well as the struts 35 and the bushings 38 in such a way as to make up a sturdy assembly. The axles of the motor assemblies with reduction gears 9–9*e* are guided within the bearings (not shown) within the rear plate 34 and the front plate 33**.

The second roller 13 is fitted on a dancer 14 and, as illustrated in FIG. 2 in its lower position, which actually corresponds to a position occupied, for instance, in the event of tape breakage or deficient functioning of the lower end switch 18. The same Figure also shows the various positions likely to be taken up by the roller 13. For example, a lower operating position of the roller 13 is represented at 13', its upper position is represented at 13'', and its inoperative or stored position is illustrated at 13'''. The various operations called up by the arrival of the roller 13 in its lower and upper operating positions will be explained hereinafter.

Figure 3:
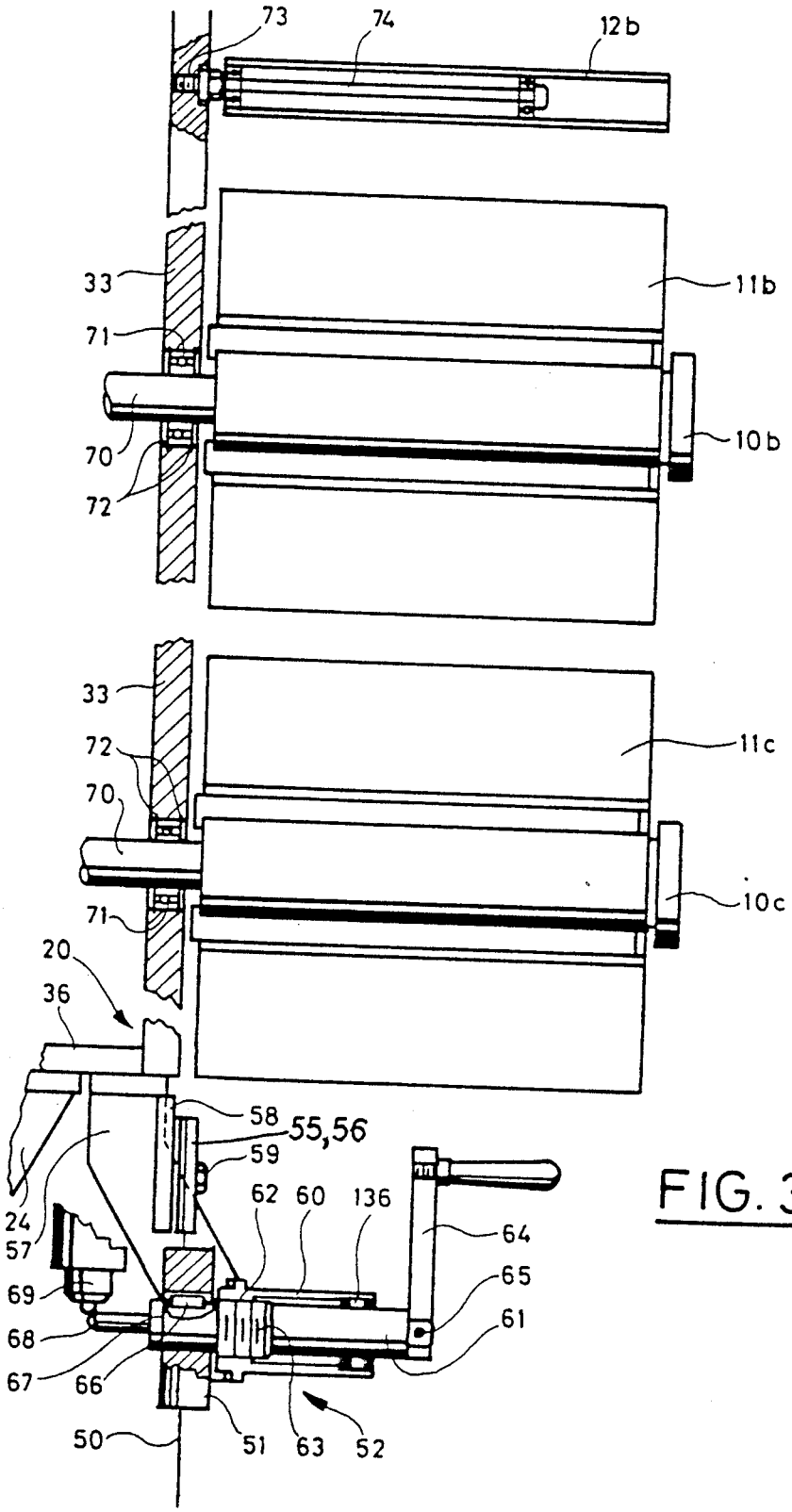
FIG. 3 is a partial cross sectional, view with portions in elevation for purposes of illustration, taken along lines III—III of FIG. 1.

In event of a tape breakage, for example if the roller 13 is in the position as shown in FIG. 2, it should be moved back to its operating position. To provide this, hoist means 40 (see FIGS. 1 and 2) consisting of a crossbar 41 between two supports 42 and 43, each with side rails 44 and 45 respectively, is able to slide on the vertical rods 46 and 47 arranged between the upper frame 20 and the lower end of the columns 22 and 23. Each support 42 and 43 has an anchor 48, 49 on which is secured the end of a cable 50, which will be wound around a drum 51 as part of a lifting device 52, which is illustrated in greater detail in FIG. 3. The cable 50 passes partially around the groove wheels or pulleys 53 and 54, which are mounted for rotation on columns 22 and 23, as well as around, grooved idler wheels or pulleys 55 and 56, which are mounted for rotation on the lifting device 52 (as best illustrated in Fig. 1). The lifting device 52, as illustrated in FIG. 3, includes a supporting bracket 57, which is mounted by threaded fasteners on a lower part of the pad 36 of the upper frame 20. A plate 58 is welded on the supporting bracket 57. The two grooved idler wheels 55 and 56 are mounted on the plate 58 by means of threaded axles 59 so as to be able to rotate. The lower part of the supporting bracket 57 is provided with a bearing 60 which receives a part of an axle 61. The bearing 60 has a tapped threaded end 62 on one of its ends, as well as a smooth bushing 136 at its other end. The axle 61 has a threaded end 63 which is screwed into the threads 62 of the bearing 60, whereas a cylindrical part of the axle is guided by the smooth bushing 136. One end of the axle 61 is provided with a crank 64 held in place by a pin 65. The other end of the axle 63 carries the drum 51 self-held by a cotter or key 66 and a stop ring 67. The end of the axle 61 extending behind the drum 51 has an extension 68 destined to operate jointly with a control switch 69 which, when actuated, will neutralize the device as long as the hoist 40 has not been positioned again to its lower position after putting broken foil tapes around their rollers 13–13*e*.

FIG. 3 also schematically illustrates the carrier hubs 10*b* and 10*c* holding the terminal wind-up reels 11*b* and 11*c*, respectively. These hubs will be described in greater detail with regard to FIGS. 5–7. As already pointed out above, the axle 70 of the motor assembly extending from the reduction gears 9–9*e* are held on the front plate 33 by bearings consisting of ball bearings 71 which are fixed in apertures in the plate 33 by stop rings 72. The roller 12*b* is mounted for rotation on an axle 74, which has one end 73 which is threaded into the plate 33. The structure of the rollers 12–12*e*, 13–13*e* and 16–16*e* is the same as that of rollers 12*b*.

Figure 4:
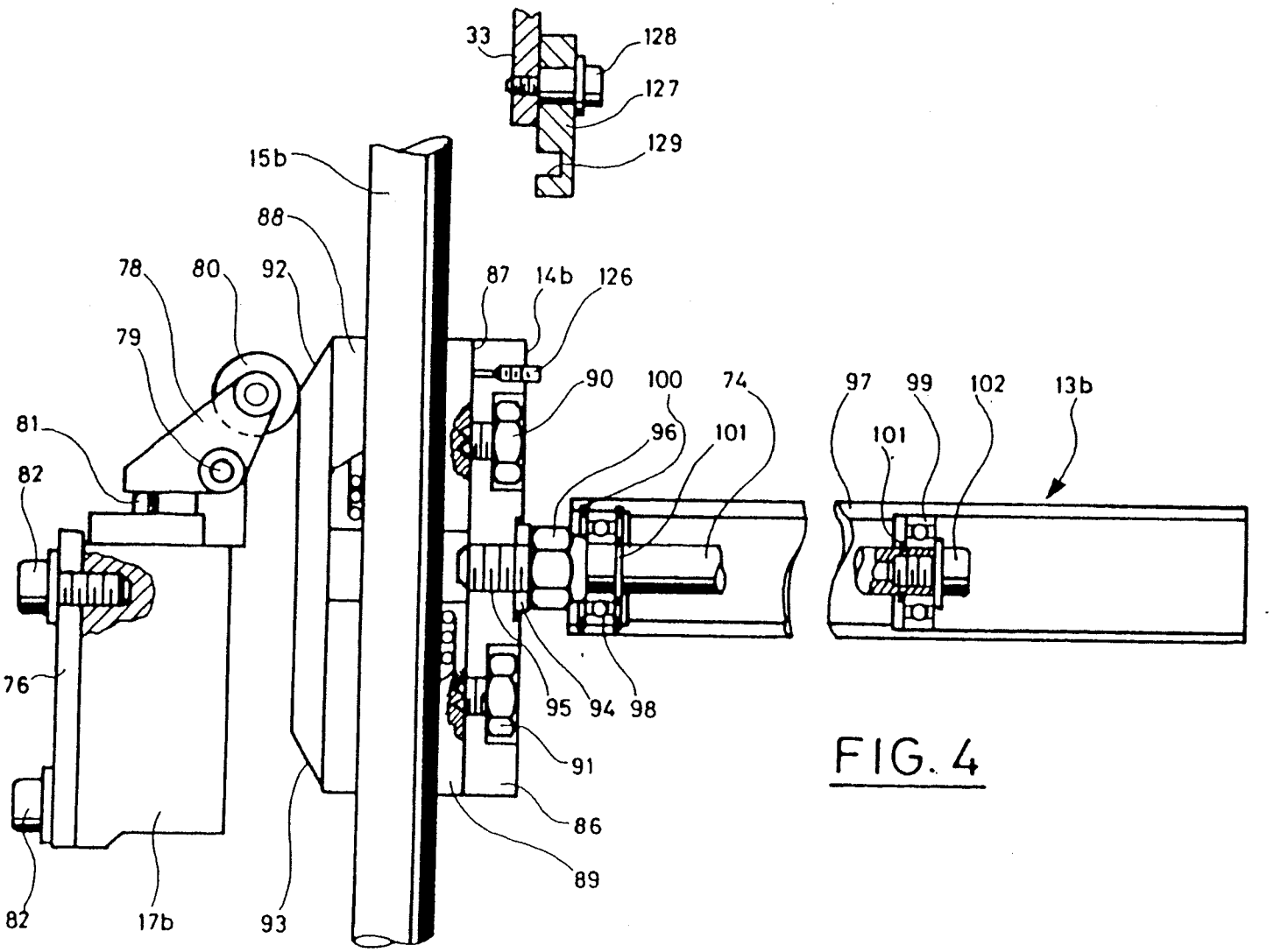
FIG. 4 is a partial cross sectional view, with portions in elevation, taken along the lines IV—IV of FIG. 1.

The roller 13*b* and dancer 14*b* are represented in FIG. 4. All of the other rollers 13–13*e*, as well as the dancers 14–14*e* are identical. The upper end switches 17–17*e* are also identical and are fitted on cross supports 76 and 77 (see FIG. 1), which are on the rear side of the columns 22 and 23, by means of screws 82 (FIG. 4). These switches are available in trade and include a lever arm 78, which is pivoted on an axis 79. One end of the lever arm 78 is provided with a roller 80, which is illustrated as being in contact with a rear part 92 of the dance 14*b*. The other end of the lever 78 acts on a control rod 81 of the switch 17*b*. The lower end switches 18–18*e* are fitted in the same manner on crossbars 83 (see FIGS. 1 and 2) and the tape breakage switches 19–19*e* are mounted on cross supports 84 and 85 similar to the cross supports 76 and 77 mentioned above (see FIGS. 1 and 2).

The dancer 14*b* includes a body 86 with a bore 87 within which two linear ball bearings 88 and 89 are arranged with their position secured by means of special screws 90 and 91. These bearings enable an unhindered and clearance-free motion of the dancer 14*b* along the vertical slide bar 15*b*, which is illustrated as being a cylindrical rod. The rear side of the dancer has a plate with two slanted surfaces 92 and 93, which will engage the rollers, such as 80, as the dancer moves thereby. For example, as the dancer moves vertically upward, the surface 92 will engage the roller. In a similar manner, if the dancer is moving from top to bottom past a switch, then the surface 93 will engage a roller of the switch.

To support the roller 13*b*, the axle 74 has a threaded end received in a threaded bore 95 of the dancer 14*b*. In addition, a washer 94 and a threaded nut 96 are provided. The roller 13*b* consists of a shell 97 which is supported on the shaft 74 by ball bearings 98 and 99. These ball bearings are held in the desired position by stop rings 100 and 101, as well as by a threaded fastener or screw 102.

Figure 5:
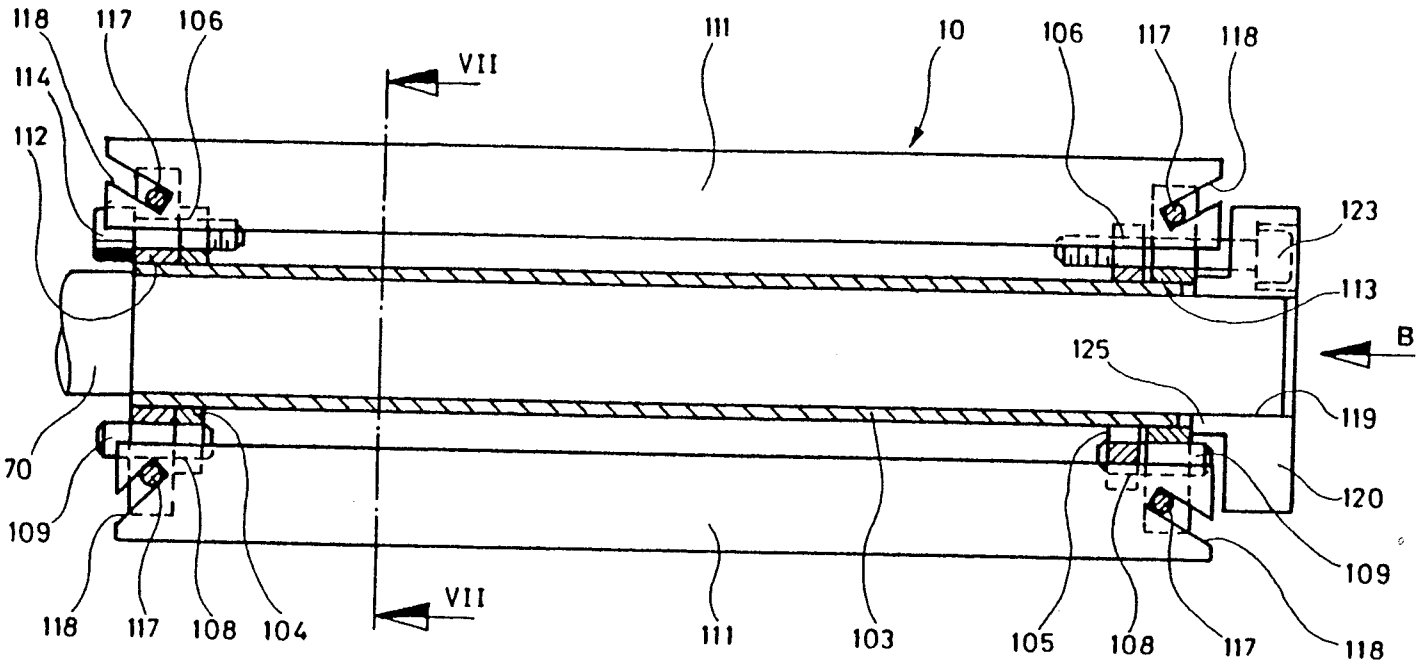
FIG. 5 is a longitudinal cross-sectional view of a reel carrier hub in accordance with the present invention.
Figure 6:
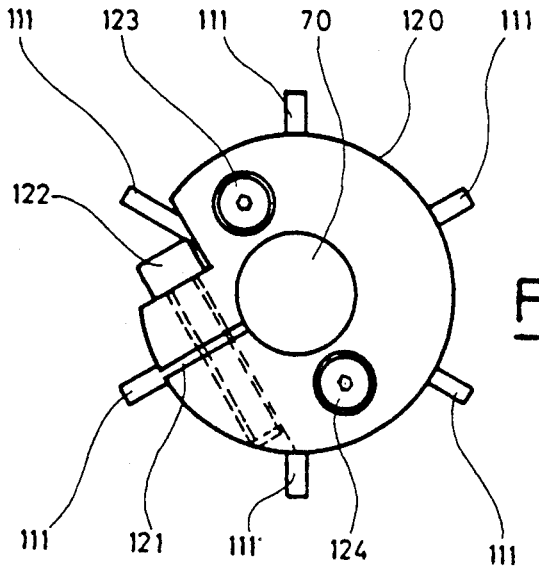
FIG. 6 is an end view of the reel carrier hub taken from the direction of arrow B of FIG. 5.
Figure 7:
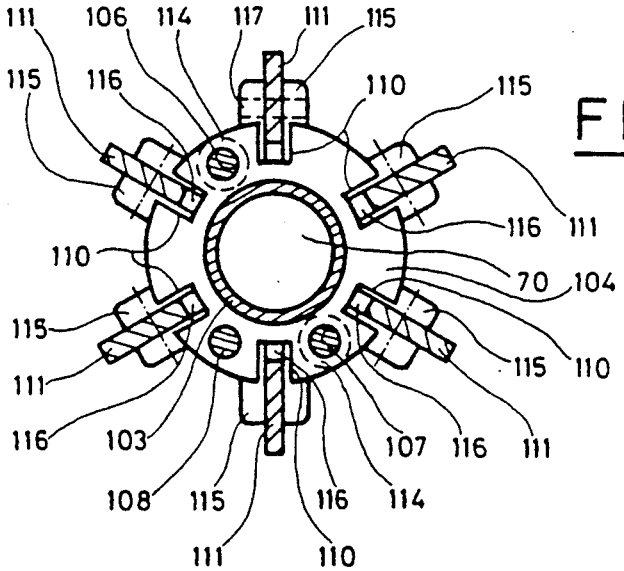
FIG. 7 is a cross sectional view taken along the lines VII—VII of FIG. 5.

A reel carrier hub 10 is illustrated in FIGS. 5–7 and includes a central tube 103 which is received on an end of the shaft 70. The central tube 103 has two flanges 104 and 105 which are welded to its ends, and each of these flanges is provided with threaded bores 106 and 107 which receive threaded fasteners (see FIG. 7). In addition, each of these rings has a smooth bore 107 which receives a cylindrical pin 109 which acts as a guide for gear-shaped or slotted rings 112 and 113. Each flange 104 and 105 has six radially extending, circumferentially spaced slots 110, which are arranged every 60° around a circumference. These slots 110 allow the adjustment of a tightening clamp comprising blade-like members or clamping bars 111, which are received therein. The notched or gear-like ring 112 is fitted on the end of the central tube with the flange 104 against which it is held by two screws 114, which are received in the tapped holes 106 and 107. The ring 112 has six radial projections 115 (see FIG. 7), which are arranged every 60° over the circumference of the ring. Every radial projection 115 has a milled surface or groove 116 with a width practically equal to the thickness of the tightening clamps or blades 111. Each of the projections 115 is provided with a cylindrical pin 117, which extends through a hole to transverse the respective slot, as best illustrated in FIG. 5. The ring 113 is, in every respect, similar to the ring 112, and is arranged in such a way as to be able to shifted axially at the end of the central tube 103. Every tightening clamp or blade 111 has, at its end, a milled notch or surface 118, which slants at approximately 30° to the axis of the tube 103 and receives the pin 117 of each of the notches 116 of the projections 115.

As illustrated in FIG. 5, the hub 10 has the clamps 111 in their outermost position. If the reel is to be loosened or, in other words, if the tightening clamps 111 are to be moved into a closer radial position toward the axle 70, it is foreseen to have a tightening ring 120 which is fitted on the end 119 of the axle 70 (see FIG. 6). For the purpose of tightening or loosening the reel, the tightening ring 120 is split in the area 121 (FIG. 6) and is crossed by a screw 122. Thus, with the screw 122 loosened, the ring 120 can be freely moved along the end 119 of the axle 70 from the position illustrated in FIG. 5 to an axially outwardly disposed position. The motion imparted to the clamps or blades 111 for tightening or loosening the reel is obtained by actuating the two screws 123 and 124, which are engaged in the threaded holes 106 and 107 of the circular flange 105. These threaded screws extend through the ring 113, which has unthreaded bores that allow free movement thereof. In this way, a screwing or unscrewing of the two screws 123 and 124 will cause the actual shifting of the tightening ring 120, which action will allow, with the loosening motion, to axial shift the ring 113 toward the right-hand side of FIG. 5 and to transfer this motion to the tightening clamps or bars 111 to allow them to radially move toward the axle 70. When the screws 123 and 124 are screwed in, a bearing or projection 125 of the tightening rings will press against the side of the ring 113 and shift it toward the left-hand side of FIG. 5, which action will then force out the clamps or bars 111, due to the cylindrical pins 117 acting on one of the surfaces of the milled slots 118. Once the reel is tightened, the tightening ring 120 is locked on the axle by tightening of the screw 122.

The rewinder 1 operates in the following manner. If it is admitted that the platen press operates with six foil tapes, as required by a given job, the six reel carrier hubs 10–10*e* are used. In this first stage, the end of each of the foil tapes is fed into the winder. The tape 4 is fed over its first idler roll 12 around the second roller 13 around the third roller 16 and is secured on the empty reel 11, which is clamped on the hub 10 by tightening of the clamping bars 111. The other tapes 4*b*–4*e* are fed in a similar manner. At this stage, the device is ready for operation and all of the dancers 14–14*e* are in the upper position 13″, as illustrated in FIG. 2. The platen press is then operated and the foil tapes which are being used will be forwarded with different rates of advance, as far as the rewinder is concerned. In this way, every one of the dancers 14–14e will effect a different descending motion and, under the effect of gravity, maintain the desired tension in each of the foil tapes 4–4e. With regard to the following discussion, we will consider the tape 4 which, as it moves into the rewinder, the dancer 14 will descend gradually until it arrives at a position 13' (see FIG. 2). At this point, the lower switch 18 will be actuated, and it will create a command to the motor gear assembly 9 to rewind the foil tape on the delivery reel 11. Owing to this operation, the dancer will raise quickly and then actuate the upper switch 17 causing an interruption in the power flowing to the motor assembly to stop the winding operation. As the tape 4 continues to be supplied to the rewinder, the dancer will thus descend and the operating cycle will start over. Each of the units will operate in this manner.

In the course of the process, if one of the foil tapes breaks, the respective dancer will drop and, thereby, actuate one of the tape breakage switches 19–19e. This action will, in turn, cause a full stop of the machine and will also cut the power flowing to the motor assemblies of the various drive motors and reduction gears 9–9e.

In such a condition, the operator will need the hoist 40. When actuating its crank 64, he will, with the help of the drum 51 and the cable 50, cause the rise of the crossbar 41 which, when operating, will lift all of the dancers 14–14e from the tape broken position. With the rotation of the shaft 61 by the crank 64, the shaft will be threaded into the threaded end 62 so that the extension 68 engages the push rod of the control switch 69. After the broken tape has been rethreaded around its dancer and secured back onto the reel, the crank can be turned in the opposite direction to lower the crossbar 41. As this happens, the unthreading of the shaft 61 will shift the extension 68 out of the position for actuating the control switch 69 so that the switch will be disengaged and, thus, the platen press and the rewinder will, again, become operative.

Depending on the circumstances, it might not be desirable to use all the reel carrier hubs 10–10e. In such a case, the non-used dancers 14–14e will be put out of operation in a storage or retracted position 13''' (see FIG. 2). To accomplish this, the lifting device 52 is used for moving the dancers 14–14e to an upper position, then the desired dancers to be inactivated are interlocked by a lever 127 (see FIG. 4) which is mounted on a front plate 33 of the upper frame 20 by means of a stud 128. The lever 127 will pivot and has a groove 129 serving as a catch for receiving a pin or projection 126 of the dancer which is to be held in the inoperative position. After the desired dancer has been placed in this inoperative position 13''', the hoist can be lowered again.

The user of such a rewinder will, thus, be able to avail himself of a simple and easy to use apparatus which insures, moreover, a large linear dancer motion range. This range allows, additionally, owing to the elastic structure of the foil tape, a limit on tape breakage and thereby increases the productivity of the platen press on which it is linked.

Although various minor modifications may be suggested by those versed in the art, it should be understood that I wish to embody within the scope of the patent granted hereon all such modifications as reasonably and properly come within the scope of my contribution to the art.

I claim:

1. A rewinder for a thin tape, particularly a tape-based metallized foil used by a machine processing sheet-like material including board, paper and plastic sheets, said rewinder comprising an upper frame connected to a lower chassis by columns and a prop, said upper frame being equipped with a rewinding appliance including a motor assembly with reduction gear, said gear having an axle carrying a reel carrier hub for receiving a terminal wind-up reel for said tape, a first and third roller for guiding the tape, means for exerting a mechanical tension on the tape including a vertical slide bar arranged between the upper frame and the lower chassis, a dancer movable on said slide bar and carrying a second roller for engaging a loop of said tape, means for controlling the operation of the motor assembly including upper and lower switches disposed along said slide bar, means for stopping said rewinder in response to a tape breakage including a tape breakage switch disposed below said lower switch to be engaged by said dancer when the tape breaks, means for lifting the dancer having a switch arrangement, said reel carrier hub including a pair of circular flanges having circumferentially spaced radial slots receiving clamping bars, each of said clamping bars being provided with end notches milled at an angle relative to an axis of said bar, a pair of notched rings having circumferentially spaced radial slots aligned with the slots in said circular flanges, said slots of said rings having pins received in the end notches of said clamping bars, a tightened clamp for shifting the rings axially relative to each other to shift the clamping bars radially inward and outward in said slots in the circular flanges.

2. A rewinder according to claim 1, wherein the dancer includes a body having a bore receiving two linear ball bearings, said ball bearings engaging said slide bar, said dancer, on one side, being provided with a pin, said upper frame having a lever fitted with a slot for engaging said pin to hold said dancer in a stored retracted position.

3. A rewinder according to claim 1, wherein the means for lifting includes a crosswise extending bar slidable on a vertical guide track extending between the upper frame and lower chassis, said crosswise bar being connected by cables to a lifting device of said means for lifting.

4. A rewinder according to claim 3, wherein the lifting device includes a drum fitted on an axle, said axle being threaded into a nut and having an extension positioned to engage said switch arrangement of the means for lifting, a crank connected to said axle so that rotation of said crank in one direction causes a windup of the cable on the drum and shifts the axle axially with said extension engaging said switch arrangement.

5. A rewinder for thin tapes, especially tape-based metallized foils used in machines processing sheet-like material, such as boards and paper, said rewinder device comprising a frame having an upper frame portion connected to a lower chassis, a rewinding appliance unit including a motor assembly with a reduction gear, an axle of said reduction gear carrying a reel carrier hub, said reel carrier hub receiving a terminal wind-up reel, a guide arrangement for said tape including a first and third roller mounted on the upper portion of said frame, means for maintaining a mechanical tension on said tape including a vertically extending slide bar extending between the upper frame and the lower chassis, a dancer movable along said slide bar, a second roller for receiving a loop of said tape being mounted on said dancer to move therewith, an upper switch and a lower switch, said rewinder including means for stopping said rewinder in response to a breakage of the tape including a tape breakage switch positioned along said slide below the lower switch, hoist means including a lifting device for lifting the dancers of the rewinder from the tape breakage position to a desired raised position, said tape for each unit being threaded into said unit over the first roller, around said second roller, to said third roller, and into said reel.

6. A rewinder according to claim 5, wherein the reel carrier hub includes a pair of fixed circular flanges having radially extending slots equally spaced along said circumference, clamping bars slidably received in said slots, each of said clamping bars having a longitudinal axis and having an end slot extending at an angle to said axis to form cam surfaces, a pair of notched rings having slots with pins for receiving the ends of said clamping bars with the pins received in the inclined end slots, means for shifting the notched rings axially relative to each other to shift the clamping bars in a radial direction to grip a reel disposed thereon.

7. A rewinder according to claim 5, wherein the dancer includes a body with a bore receiving linear ball bearings for supporting the dancer on said vertical sliding bar.

8. A rewinder according to claim 7, which includes latch means for holding said dancer in a retracted position including a projection on the body of said dancer and a lever having a slot for receiving said projection being mounted on the upper frame member.

9. A rewinder according to claim 5, wherein the lifting device includes a drum having cables extending to a crossbar, said drum being keyed to a drum axle, a crank for rotating said drum axle, said drum axle having a threaded end threaded into a threaded nut and mounted for axial movement in response to rotation of said drum axle, said drum axle having an extension extending to a vicinity of a control switch so that rotation of said drum axle to cause the drum to lift the dancer shifts said extension into engagement with said control switch.

10. A rewinder according to claim 5, which has more than one rewinding appliance unit.

* * * * *